US009873578B2

(12) United States Patent
Nishii

(10) Patent No.: US 9,873,578 B2
(45) Date of Patent: Jan. 23, 2018

(54) RECORDING MEDIUM CONVEYING DEVICE AND IMAGE FORMING APPARATUS INCORPORATING SAME

(71) Applicant: Toshikane Nishii, Osaka (JP)

(72) Inventor: Toshikane Nishii, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 109 days.

(21) Appl. No.: 14/966,187

(22) Filed: Dec. 11, 2015

(65) Prior Publication Data

US 2016/0167904 A1 Jun. 16, 2016

(30) Foreign Application Priority Data

Dec. 15, 2014 (JP) ..... 2014-252957

(51) Int. Cl.

| | |
|---|---|
| ***B65H 5/36*** | (2006.01) |
| ***G03G 15/00*** | (2006.01) |
| ***B65H 29/52*** | (2006.01) |
| *B65H 85/00* | (2006.01) |

(52) U.S. Cl.

CPC ..... *B65H 5/36* (2013.01); *B65H 29/52* (2013.01); *G03G 15/6529* (2013.01); *B65H 85/00* (2013.01); *B65H 2301/33312* (2013.01); *B65H 2402/5152* (2013.01); *B65H 2404/63* (2013.01); *G03G 15/6573* (2013.01); *G03G 2215/00675* (2013.01); *G03G 2215/00679* (2013.01)

(58) Field of Classification Search

CPC . B65H 5/36; B65H 5/38; B65H 29/52; B65H 2404/50; B65H 2404/5214; B65H 2402/5152; B65H 2402/5153; G03G 15/657

See application file for complete search history.

(56) References Cited

U.S. PATENT DOCUMENTS

| | | | | |
|---|---|---|---|---|
| 8,322,715 | B2 * | 12/2012 | Mandel | B65H 5/062 271/264 |
| 2006/0153624 | A1 * | 7/2006 | Maeda | B41J 11/002 400/636 |
| 2008/0224385 | A1 | 9/2008 | Takahira et al. | |
| 2009/0110459 | A1 | 4/2009 | Honda et al. | |
| 2009/0174135 | A1 | 7/2009 | Tanaka et al. | |
| 2010/0314827 | A1 | 12/2010 | Nishii et al. | |

(Continued)

FOREIGN PATENT DOCUMENTS

| | | |
|---|---|---|
| JP | 2007-276934 | 10/2007 |
| JP | 2007-331931 | 12/2007 |

(Continued)

OTHER PUBLICATIONS

Machine translation of JP 2013073263 A, retrieved May 25, 2017.*

*Primary Examiner* — Michael C McCullough
(74) *Attorney, Agent, or Firm* — Harness, Dickey & Pierce, P.L.C.

(57) ABSTRACT

A recording medium conveying device includes a guide, a shaft, and a positioner. The guide guides a recording medium along a conveyance path to a predetermined direction. The shaft is disposed near the conveyance path. The guide is disposed between the conveyance path and the shaft. The positioner positions the guide in an axial direction of the shaft. The guide is fixed by both the positioner and the shaft. The positioner is fixed separately from the shaft.

18 Claims, 9 Drawing Sheets

(56) References Cited

U.S. PATENT DOCUMENTS

| | | | |
|---|---|---|---|
| 2011/0058873 | A1 | 3/2011 | Honda et al. |
| 2011/0217058 | A1 | 9/2011 | Honda et al. |
| 2011/0285076 | A1 | 11/2011 | Fujiwara et al. |
| 2011/0291353 | A1 | 12/2011 | Fujiwara et al. |
| 2013/0106050 | A1 | 5/2013 | Nishii et al. |
| 2014/0091518 | A1 | 4/2014 | Nishii et al. |

FOREIGN PATENT DOCUMENTS

| | | | | | |
|---|---|---|---|---|---|
| JP | 2008-189393 | | | 8/2008 | |
| JP | 2008-222388 | | | 9/2008 | |
| JP | 2009-161301 | | | 7/2009 | |
| JP | 2009-202987 | | | 9/2009 | |
| JP | 2010-179981 | | | 8/2010 | |
| JP | 2010-195568 | | | 9/2010 | |
| JP | 2010-215346 | | | 9/2010 | |
| JP | 2012-180145 | | | 9/2012 | |
| JP | 2013-075766 | | | 4/2013 | |
| JP | 2013073263 | A | * | 4/2013 | ..... B65H 29/40 |
| JP | 2013-180899 | | | 9/2013 | |
| JP | 2013-216448 | | | 10/2013 | |
| JP | 2014-149365 | | | 8/2014 | |
| JP | 2014-177315 | | | 9/2014 | |
| JP | 2014-178481 | | | 9/2014 | |
| JP | 2014-206607 | | | 10/2014 | |

* cited by examiner

-- CONVENTIONAL ART --

RECORDING MEDIUM CONVEYING DEVICE AND IMAGE FORMING APPARATUS INCORPORATING SAME

CROSS-REFERENCE TO RELATED APPLICATION

This patent application is based on and claims priority pursuant to 35 U.S.C. §119(a) to Japanese Patent Application No. 2014-252957, filed on Dec. 15, 2014, in the Japan Patent Office, the entire disclosure of which is hereby incorporated by reference herein.

BACKGROUND

1. Technical Field

Aspects of the present disclosure relate to a recording medium conveying device and an image forming apparatus that incorporates the recording medium conveying device.

2. Description of the Related Art

An image forming apparatus used in, for example, a copier, a printer, a fax machine, or a multifunction peripheral thereof includes a recording medium conveying device to convey a recording medium to a predetermined direction. In such a recording medium conveying device, a recording medium may be conveyed to a predetermined conveying unit in a wrong direction due to, for example, a curl at a leading end in the conveyance direction of the recording medium. Such conveyance in the wrong direction may produce a fold or a bend at the leading end of the recording medium and cause jamming of the recording medium inside the apparatus.

SUMMARY

In an aspect of the present disclosure, there is provided a recording medium conveying device that includes a guide, a shaft, and a positioner. The guide guides a recording medium along a conveyance path to a predetermined direction. The shaft is disposed near the conveyance path. The guide is disposed between the conveyance path and the shaft. The positioner positions the guide in an axial direction of the shaft. The guide is fixed by both the positioner and the shaft. The positioner is fixed separately from the shaft.

In another aspect of the present disclosure, there is provided an image forming apparatus including the recording medium conveying device.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
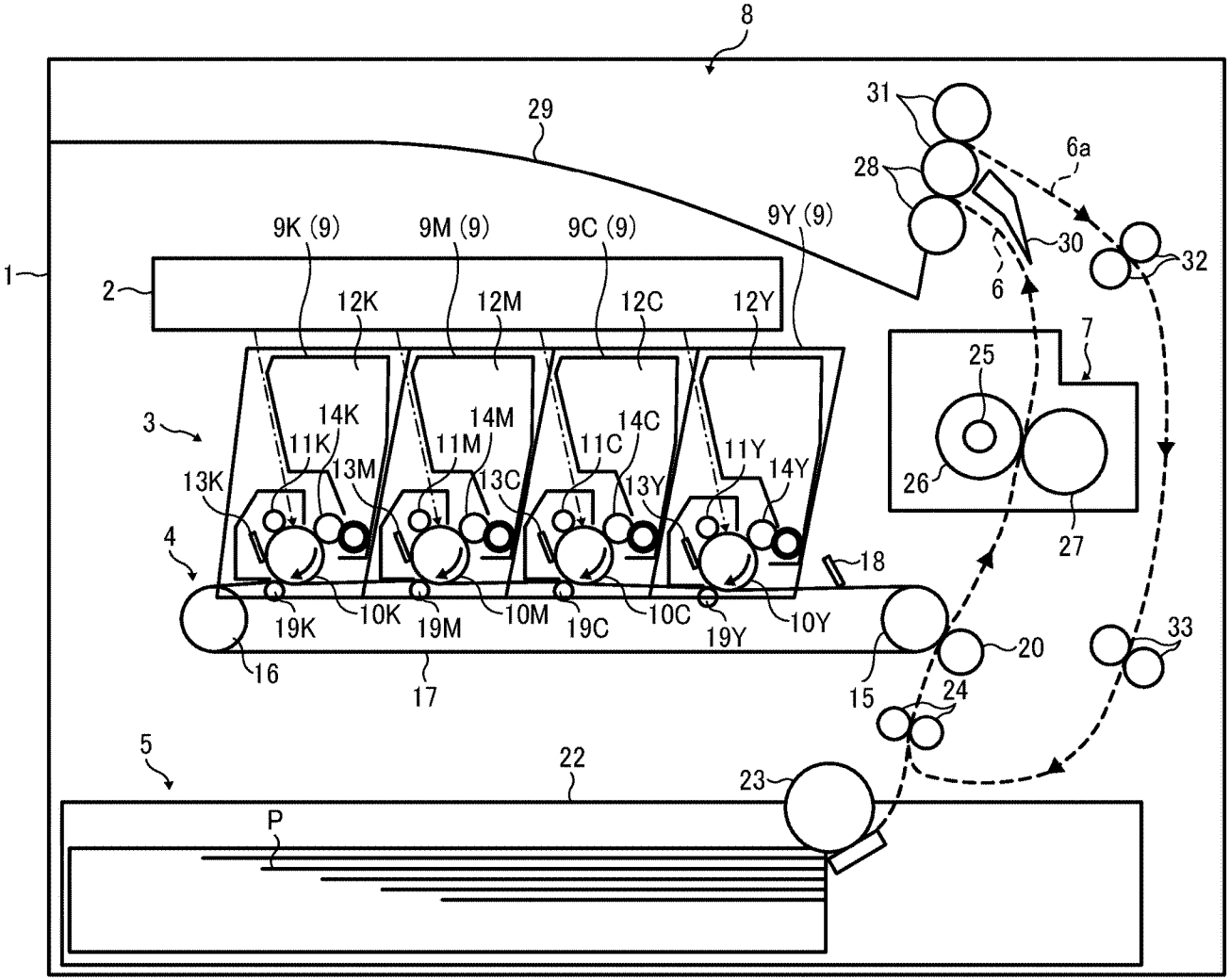
FIG. 1 is a schematic view of a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

An embodiment according to the present invention will be described below with reference to the drawings. In the drawings, the same or equivalent component will be appended with the same reference sign and repeated description thereof will be simplified or omitted as required.

Figure 14:
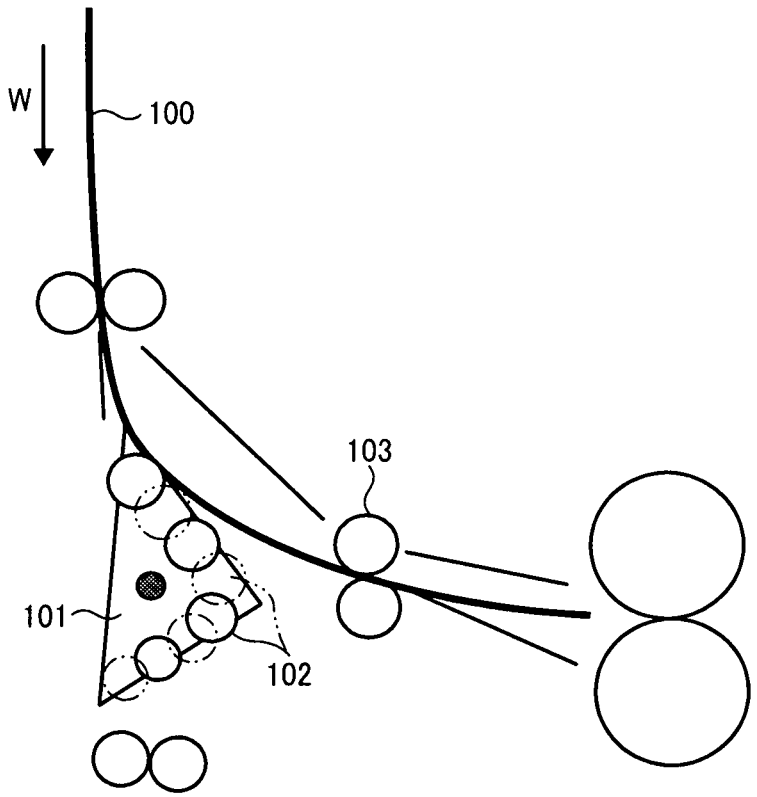
FIG. 14 is a sectional view of a comparative example of an image forming apparatus.

To properly convey a recording medium to a conveyor, for example, as illustrated in FIG. 14, a guide member 101 having a plurality of roller guides 102 may be disposed on the course of a conveyance path 100 of a recording medium. The recording medium conveyed in a direction indicated by arrow W on the conveyance path 100 is guided by the roller guides 102 toward an ejection roller 103.

The guide member 101 allows the recording medium to be guided in a proper direction. However, for the guide member 101 to guide the recording medium, there occurs a certain error in a direction to guide the recording medium, due to an assembly error or a dimensional error. In addition, when the guide member 101 and the ejection roller 103, which is the destination of guidance of the guide member 101, are disposed independent of each other, an error might occur in the direction to guide the recording medium, due to, e.g., an assembly error of the guide member 101 and the ejection roller 103. Accordingly, the accuracy of the direction in which the guide member 101 guides the recording medium might decrease, thus hampering the recording medium conveying device from properly conveying the recording medium to a target direction.

However, according to at least one embodiment of this disclosure, a guide to guide a recording medium to a predetermined direction is positioned with a shaft, and the relative positions of the shaft and the guide hardly changes even when there is an error in the assembly position of the shaft. Such a configuration allows the guide in combination with the shaft to accurately guide the recording medium in a target direction. For example, the guide accurately guides the recording medium toward the shaft. Alternatively, the guide accurately guides the recording medium in a direction so that the recording medium does not contact the shaft.

FIG. 1 is a schematic view of a configuration of an image forming apparatus according to an embodiment of this disclosure. As illustrated in FIG. 1, an image forming apparatus 1 includes an exposing unit 2, an image forming unit 3, a transfer unit 4, a sheet feed section 5, a main conveyance path 6 and a reverse conveyance path 6*a* along which a recording medium is conveyed, a fixing device 7, and an ejection section 8.

The exposing unit 2 is positioned in the upper portion of the image forming apparatus 1 and configured with a light source that emits, for example, laser light, and optical systems. Specifically, a laser light is generated for each color separation component of an image which is produced based from image data obtained by an image acquisition unit, and the laser light is emitted to a photoconductor of the image forming unit 3, which will be described later, to expose the surface of the photoconductor.

The image forming unit 3 is positioned below the exposing unit 2 and includes a plurality of process units 9 which is detachable to the image forming apparatus 1. The process units 9 are, for example, four process units 9 (9Y, 9C, 9M, and 9Bk) corresponding to yellow, cyan, magenta, and black, respectively, which are different color separation components of the color image. Each of the process units 9 (9Y, 9C, 9M, and 9Bk) includes a photoconductor drum 10 (10Y, 10C, 10M, or 10Bk) serving as a rotary drum that can carry toner, or developer, on its surface, a charging roller 11 (11Y, 11C, 11M, or 11Bk) that uniformly charges the surface of the photoconductor drum 10, a developing device 12 (12Y, 12C, 12M, or 12Bk) that supplies toner to the surface of the photoconductor drum 10, and a photoconductor cleaning blade 13 (13Y, 13C, 13M, or 13Bk) that cleans the surface of the photoconductor drum 10. The process units 9 (9Y, 9C, 9M, and 9Bk) have similar configurations except that each process unit 9 contains a different color toner, and thus color suffixes (Y, C, M, and Bk) are omitted below unless colors particularly specified.

The transfer unit 4 is positioned beneath the image forming unit 3. The transfer unit 4 includes an endless intermediate transfer belt 17 that is tensioned and runs about a drive roller 15 and a driven roller 16 to circulate, a cleaning blade 18 that cleans the surface of the intermediate transfer belt 17, and primary transfer rollers 19 each disposed to oppose the photoconductor drum 10 of the corresponding process unit 9 with the intermediate transfer belt 17 therebetween. Each primary transfer roller 19 presses the inner circumferential face of the intermediate transfer belt 17 at each position. A primary transfer nip is formed at the portion where the pressed portion of the intermediate transfer belt 17 makes contact with the photoconductor drum 10.

A secondary transfer roller 20 is disposed to oppose the drive roller 15 with the intermediate transfer belt 17 therebetween. The secondary transfer roller 20 presses the outer circumferential face of the intermediate transfer belt 17, and a secondary transfer nip is formed at the portion where the secondary transfer roller 20 makes contact with the intermediate transfer belt 17.

The sheet feed section 5 is positioned in the lower portion of the image forming apparatus 1 and includes a sheet feed tray 22 storing recording sheets P, which are recording mediums, and a sheet feed roller 23 that conveys the recording sheet P from the sheet feed tray 22.

The main conveyance path 6 is a conveyance path along which the recording sheet P fed from the sheet feed section 5 is conveyed. Beside a registration roller pair 24, conveyance roller pairs are suitably disposed on the course of the main conveyance path 6 to the ejection section 8, which will be described later.

The fixing device 7 includes a fixing roller 26 that is heated by a heat source 25, and a pressure roller 27 that is able to press the fixing roller 26.

The ejection section 8 is provided on the most downstream of the main conveyance path 6 of the image forming apparatus 1. The ejection section 8 is provided with a sheet ejection roller pair 28 that ejects the recording sheet P, and a sheet ejection tray 29 for storing the ejected recording sheet P. The ejection section 8 is also provided with a bifurcating claw 30 that changes the conveyance direction of the recording sheet P, and a reverse roller pair 31 that sends out the recording sheet P to the reverse conveyance path 6*a* (one of the reverse rollers serves as the sheet ejection roller 28 as well).

The duplex roller pairs 32 and 33 are provided on the reverse conveyance path 6*a*.

The basic operation of the image forming apparatus 1 will now be described referring to FIG. 1.

When an image forming operation starts in the image forming apparatus 1, an electrostatic latent image is formed on the surface of the photoconductor drum 10 of each of the process units 9Y, 9C, 9M, and 9Bk. The image information exposed on each photoconductor drum 10 is a single color information. Each single color information of yellow, cyan, magenta, and black is produced by separating a desired full color image. An electrostatic latent image is formed on each photoconductor drum 10. The drum-shaped developing roller 14 supplies the toner stored in each developing device 12 to the photoconductor drum 10, and the electrostatic latent image is made visible as a toner image (developer image).

The drive roller 15 of the transfer unit 4 is rotatably driven, counter-clockwise in the figure, to drive the intermediate transfer belt 17 to run in the direction indicated by an arrow A in the figure. A constant voltage of opposite polarity to the toner charge polarity or a voltage controlled under a constant current is applied to each primary transfer roller 19. In this manner, a transfer electric field is generated at the primary transfer nip between each primary transfer roller 19 and the corresponding photoconductor drum 10. A toner image of each color formed on the photoconductor drum 10 of each of the process units 9Y, 9C, 9M, and 9Bk is transferred onto the intermediate transfer belt 17 in a sequentially overlapping manner by the transfer electric field generated at the primary transfer nip. Thus, a full color toner image is formed on the surface of the intermediate transfer belt 17. Toner remaining on the photoconductor drum 10 after the primary transfer is removed by the photoconductor cleaning blade 13 and stored in a waste toner container.

In the lower portion of the image forming apparatus 1, the sheet feed roller 23 of the sheet feed section 5 is rotatably driven to feed a recording sheet P stored in the sheet feed tray 22 to the main conveyance path 6 when an image forming operation starts. At a timing measured by the registration roller pair 24, the recording sheet P fed to the main conveyance path 6 is sent to the secondary transfer nip between the secondary transfer roller 20 and the drive roller 15 opposing the secondary transfer roller 20. In this step, a transfer voltage of opposite polarity to the toner charge polarity of the toner image on the intermediate transfer belt 17 is applied to the secondary transfer roller 20 to generate a transfer electric field at the secondary transfer nip. The toner image on the intermediate transfer belt 17 is collectively transferred onto the recording sheet P by the transfer electric field generated at the secondary transfer nip.

The recording sheet P on which the toner image is transferred is conveyed to the fixing device 7. By the fixing roller 26 heated by the heat source 25 and the pressure roller 27, the recording sheet P is heated and pressed so that the toner image is fixed onto the recording sheet P. The recording sheet P with the fixed toner image is separated from the fixing roller 26, conveyed by the conveyance roller pair, and then ejected to the sheet ejection tray 29 in the ejection section 8 by the sheet ejection roller pair 28.

To form images on both sides of the recording sheet P, a bifurcating claw 30 is rotated by a solenoid to change the conveyance path of the recording sheet P between the fixing device 7 and the ejection section 8, thereby sending the recording sheet P to the reverse roller pair 31.

At a timing before the trailing edge of the recording sheet P sent to the reverse roller pair 31 completely comes out of the reverse roller pair 31, the recording sheet P is conveyed in the reverse direction to the reverse conveyance path 6*a*. The recording sheet P is conveyed along the reverse conveyance path 6*a* by, for example, the duplex roller pairs 32 and 33 provided on the reverse conveyance path 6*a* to return to the main conveyance path 6 with the front and back faces of the sheet reversed. Then in a manner similar to the front face, an image is formed on the back face and fixed, and then the recording sheet P is ejected from the sheet ejection tray 29.

The image forming operation described above is for forming a full color image on the recording sheet P though, a single color image can be formed using one of the four process units 9Y, 9C, 9M, and 9Bk, or a two-color image or a three-color image can be formed using two or three process units 9.

The image forming apparatus 1 is provided with a plurality of roller pairs (that is, the registration roller pair 24 and the duplex roller pair 32), which function as conveying units to convey the recording sheet P, on the course of the main conveyance path 6 and the reverse conveyance path 6*a*. A guide is provided in the image forming apparatus 1 to guide the recording sheet P to the roller pair in a right direction. A recording medium conveying device 200 including the conveying unit and the guide will now be described.

First, a recording medium conveying device 200C not including a guide according to an embodiment of the present invention will be described as a comparative example, with reference to FIGS. 2 through 4 in order to explain the problem to be solved by an embodiment of the present invention.

Figure 2:
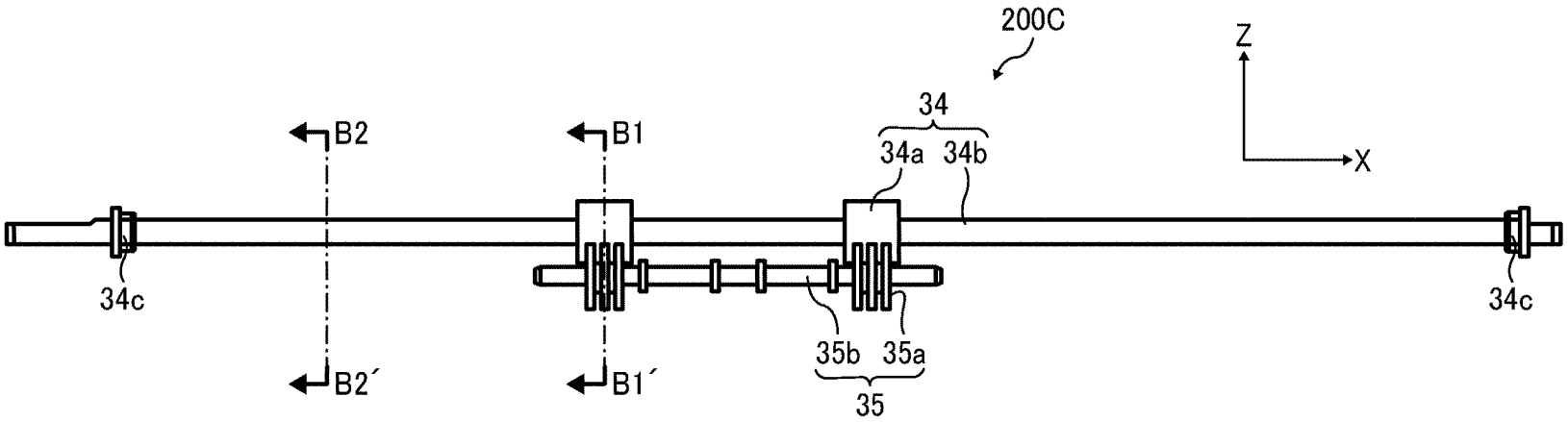
FIG. 2 is a plan view of a configuration of a duplex conveyance roller pair in a comparative example.

FIG. 2 illustrates the configuration of a conveyance roller 34 serving as the conveyer for conveying a recording sheet P, and a conveyance driven roller 35. The conveyance roller 34 and the conveyance driven roller 35 compose a roller pair provided on the course of a reverse conveyance path 6*a*, serving, in this configuration, as the duplex roller pair 32 in FIG. 1.

The conveyance roller 34 includes a conveyance roller body 34*a*, and a conveyance roller shaft 34*b*, which is the shaft of the conveyance roller 34, serving as a shaft member. Conveyance roller bearings 34*c* are provided on both ends of the conveyance roller shaft 34*b*. The conveyance roller body 34*a* is made of a rubber material, and the conveyance roller shaft 34*b* is made of metal to have sufficient rigidity to serve as the shaft of the conveyance roller 34. The conveyance roller shaft 34*b* extends in X direction in the figure.

The conveyance driven roller 35 is provided to oppose the conveyance roller 34. The conveyance driven roller 35 is configured with the conveyance driven roller body 35*a* and the conveyance driven roller shaft 35*b*.

The conveyance driven roller body 35*a* is pressed toward the conveyance roller body 34*a* by a pressing unit. The conveyance driven roller body 35*a* making contact with the conveyance roller body 34*a* is rotatably driven by the conveyance roller body 34*a* rotated by the drive unit, thereby conveying the recording sheet P passing between the conveyance roller body 34*a* and the conveyance driven roller body 35*a* downstream. With the conveyance roller shaft 34*b* fitted in the conveyance roller bearing 34*c*, the conveyance roller 34 is restricted from moving in the axial direction and thereby stays in a predetermined position while rotating.

Figure 3:
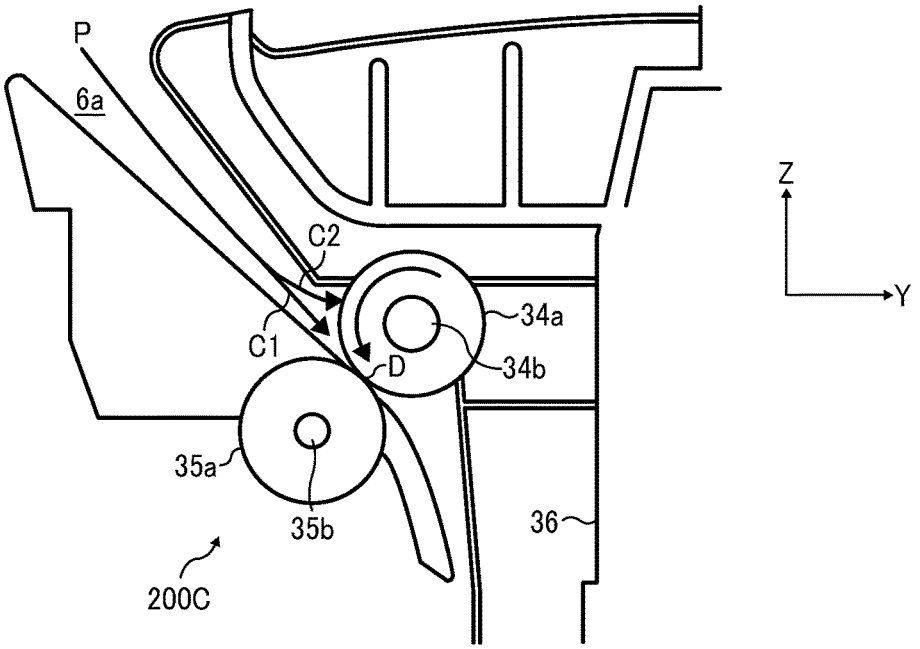
FIG. 3 is a sectional view of a possible problem that happens during conveyance of a recording sheet in the comparative example.

FIG. 3 is a sectional view of the conveyance roller body 34*a* taken along the line B1-B1' in FIG. 2. A front cover 36 is provided in front of the conveyance roller 34 as an exterior portion of the image forming apparatus 1. By fixing the conveyance roller bearing 34*c* to the front cover 36, the position of the conveyance roller 34 in Y and Z directions in the figure is fixed.

The reverse conveyance path 6*a* including the duplex roller pair 32 (the conveyance roller 34 and the conveyance driven roller 35), along which the recording sheet P is conveyed, is provided in a manner opposing the front cover 36. The reverse conveyance path 6*a*, which generally requires a large space for reversing the recording sheet P and a very long total path, is usually provided near the exterior portion of the image forming apparatus 1 where a large space can be secured. Therefore, in a first embodiment, the reverse conveyance path 6*a* is provided in a manner opposing the front cover 36, which is an exterior portion of the image forming apparatus 1. The front cover 36 is provided so as to intersect with the direction indicated by an arrow C2, which is one of conveyance directions of the recording sheet P as will be described later. When the recording sheet P curls and deviates out of the conveyance path, the recording sheet P is conveyed in the direction indicated by the arrow C2.

Regarding the conveyance of the recording sheet P by the conveyance roller 34 and the conveyance driven roller 35, the recording sheet P is desirably conveyed in the direction indicated by an arrow C1 to be delivered to a nipping portion D between the conveyance roller 34 and the conveyance driven roller 35. The recording sheet P however might be conveyed in the direction toward the conveyance roller 34 indicated by the arrow C2 in a case, for example, when the leading edge of the recording sheet P is curled.

In such a case, the leading edge of the recording sheet P conveyed in the direction indicated by the arrow C2 contacts the conveyance roller body 34*a* at a section where the conveyance roller body 34*a* is provided. The conveyance direction of the recording sheet P is corrected by the rotating conveyance roller body 34*a* and the recording sheet P is guided to the nipping portion D at this section.

Figure 4:
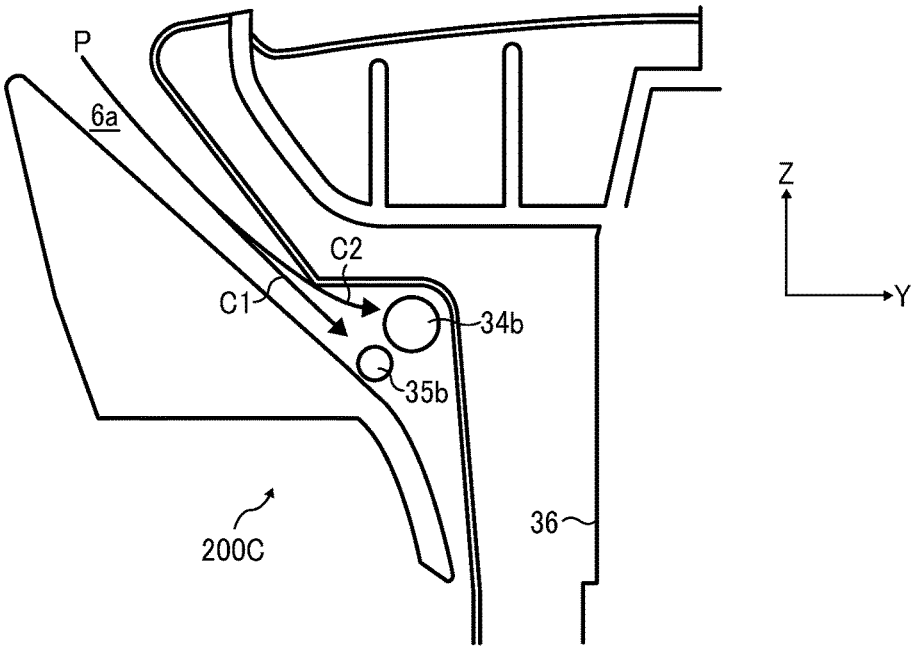
FIG. 4 is a sectional view of a possible problem that happens during conveyance of a recording sheet in the comparative example.

FIG. 4 is a sectional view of the conveyance roller shaft 34*b* taken along the line B2-B2' in FIG. 2. As illustrated in FIG. 4, in a section where the conveyance roller body 34*a* is not disposed, the recording sheet P conveyed in the direction indicated by the arrow C2 contacts the conveyance roller shaft 34*b*, which has a smaller diameter than the conveyance roller body 34*a*. The conveyance roller shaft 34*b* made of metal has smaller coefficient of friction than the conveyance roller body 34*a*. Thus, the recording sheet P is not likely to be guided by the rotating conveyance roller shaft 34*b* toward the nipping portion D, and jamming of the leading edge of the sheet is likely to happen at this section.

Since the surface temperature of metal does not rise rapidly due to its large heat capacity, exposure in water vapor under low temperature causes condensation. In such a case, when the leading edge of the recording sheet P contacts the metal conveyance roller shaft 34*b*, the leading edge of the sheet catches water drops. When the wet recording sheet P is conveyed to the transfer unit 4, fixing may not be performed correctly in the fixing device 7, which causes image defects. Therefore, the contact between the recording sheet P and the conveyance roller shaft 34*b* should be avoided.

A known solution to the aforementioned problem is to attach a thin resin sheet member to, for example, a case of the image forming apparatus 1 so that the sheet member is disposed between the conveyance path of the recording sheet P and the conveyance roller shaft 34*b*. However this solution has disadvantages such that the sheet member having low strength is not sufficiently effective in guiding the recording sheet P to a desired direction, the sheet member is likely to deform by heat, and the sheet member easily come off the casing.

These problems can be solved by a recording medium conveying device 200 according to an embodiment of the present invention that includes a guide that guides the recording sheet P in the right direction. A recording medium conveying device 200 according to the first embodiment will now be described.

Figure 5A:
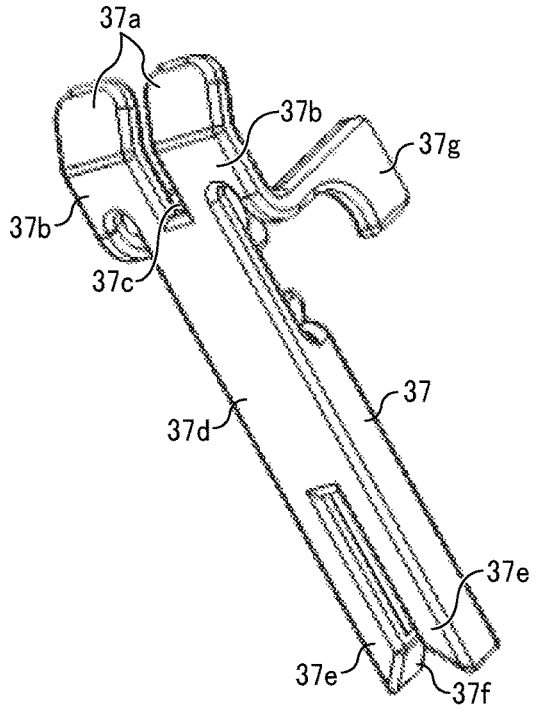
FIG. 5A is a perspective view of a guide according to a first embodiment of the present invention.
Figure 5B:
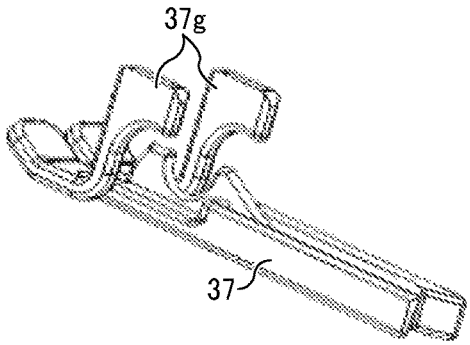
FIG. 5B is a perspective view of the guide of FIG. 5A seen from a different angle from an angle of FIG. 5A.

As illustrated in FIG. 5A, a guide 37 includes two bent portions 37*a* at its upstream end in the conveyance direction. A root portion 37*b* continues from each of the two bent portions 37*a* to the downstream in the conveyance direction. An upstream groove 37*c* is provided between the two root portions 37*b*. In the further downstream in the conveyance direction of the root portion 37*b*, a guide face 37*d* is provided in the middle portion of the guide 37 to guide the recording sheet P. In the end portion in the downstream side of the guide 37, two downstream ends 37*e* continue from the guide face 37*d* to project toward the downstream in the conveyance direction. A downstream groove 37*f* is provided between the two downstream ends 37*e*. As described above, the guide 37 has two bent portions 37*a* in the upstream side and two downstream ends 37*e* in the downstream side, namely, the guide 37 is bifurcated at both ends in the conveyance direction. A deformable portion 37*g* branches off to the back side from the root portion 37*b*. Although the portions of the guide 37 are named, for example, the guide face 37*d* for convenience of description, the function of each component of the guide 37 is not necessarily limited to the function represented by its name. For example, the root portion 37*b* may make contact with the recording sheet P to guide the recording sheet P toward the reverse conveyance path 6*a*, that is, the root portion 37*b* can also have a function of a guide face for guiding the recording sheet P.

Figure 6:
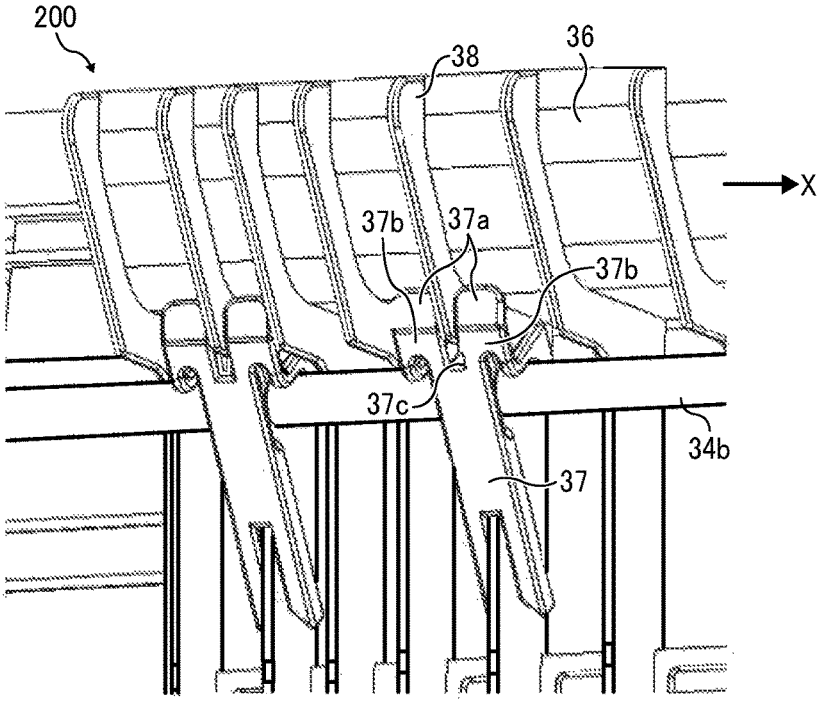
FIG. 6 is a perspective view of the assembled guide according to the first embodiment.

As illustrated in FIG. 6, the guide 37 is provided by hanging the deformable portion 37*g* on the conveyance roller shaft 34*b*. In this manner, the position of the guide 37 in Y and Z directions can be determined.

Since the guide 37 is positioned to the conveyance roller shaft 34*b*, an error in the relative position of the guide 37 to the conveyance roller shaft 34*b* is minimized. With this positional relationship between the guide 37 and the conveyance roller shaft 34*b*, the guide 37 can accurately guide the recording sheet P. In the embodiment as configured above, the guide 37 can accurately guide the recording sheet P to the direction that avoids contact with the conveyance roller shaft 34*b*.

Since the error in the relative position of the guide 37 to the conveyance roller shaft 34*b* is minimized, the error in the relative position of the guide 37 to the conveyance roller body 34*a* including a shaft, that is, the conveyance roller shaft 34*b*, is also minimized. Thus, the guide 37 according to the first embodiment is capable not only of accurately guiding the recording sheet P to the direction which avoids contact with the conveyance roller shaft 34*b* but also of accurately guiding the recording sheet P to the direction which causes contact with the outer circumference of the conveyance roller body 34*a*. Thus, the recording sheet P is accurately guided to the nipping portion of the duplex roller pair 32 (the nipping portion created by the conveyance roller body 34*a* making contact with the conveyance driven roller body 35*a*), and thus the duplex roller pair 32 conveys the recording sheet P further downstream in the right direction.

As described above, the effect of the embodiment of the present invention can be achieved not only by the relationship between the guide 37 and the conveyance roller shaft 34*b*, which is a shaft member, but also by the relationship between the guide 37 and a member (the conveyance roller body 34*a*) provided on the shaft member. Since the error in the relative position of the guide 37 to a shaft member or a member provided on the shaft member (hereinafter referred to as shaft component) is minimized, the recording sheet P can accurately be guided to the direction that avoids contact with the shaft component, or to the direction that causes contact with the shaft component.

Figure 7:
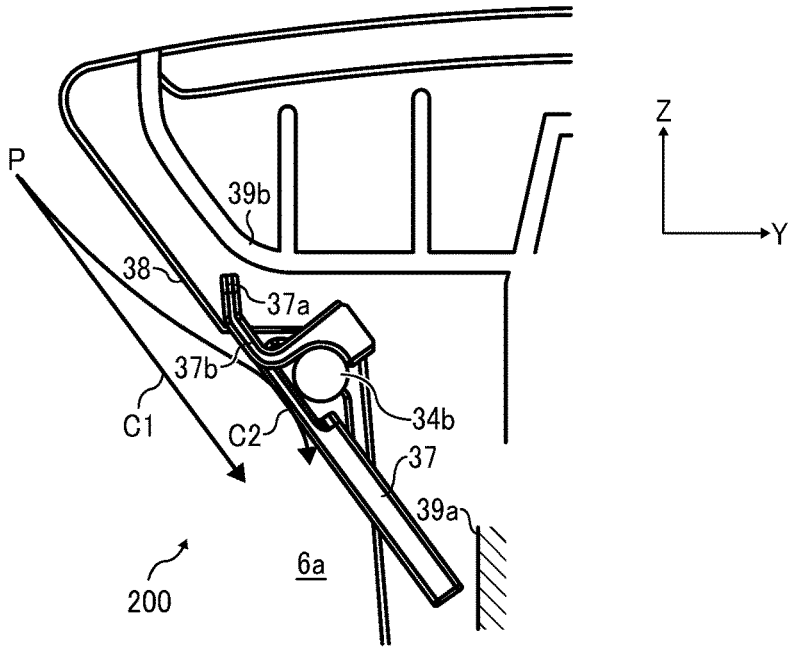
FIG. 7 is a sectional view of the recording medium conveying device according to the first embodiment that guides a recording sheet.

As illustrated in FIG. 7, a conveyance rib 38, which is a positioner, is fixed on the front cover 36. At a location on the conveyance roller shaft 34*b* where the guide 37 is provided, the conveyance rib 38 is inserted in the upstream groove 37*c* to be interposed between the root portions 37*b*. With this configuration, the movement of the guide 37 in the X direction is restricted within the range between sections where the left and right root portions 37*b* abut the conveyance rib 38 (that is, within the width of the upstream groove 37*c*). The position of the guide 37 in the X direction is thus determined. The axial movement of the conveyance roller shaft 34*b* has almost no effect on the position of the guide 37 in the X direction because the guide 37 can only move within the range described above and the conveyance rib 38 fixed to the front cover 36 cannot move in the X direction.

The conveyance rib 38 inserted in the upstream groove 37*c* is also inserted in the downstream groove 37*f* to be interposed between the two downstream ends 37*e*. By interposing the conveyance rib 38 at the upper and lower sides of the guide 37 to position the guide 37 in the X direction, the posture of the guide 37 in the X direction is further stabilized.

As described above, the position of the guide 37 in three dimensions, that is, X, Y, and Z directions, is determined by the conveyance roller shaft 34*b* and the conveyance rib 38. Since the guide 37 is rotatable about the conveyance roller shaft 34*b*, rotation restrictors 39*a* and 39*b* are provided at predetermined locations on the front cover 36 as illustrated in FIG. 7. The rotating restrictor 39*a* restricts the counter-clockwise rotation of the guide 37, and the rotating restrictor 39*b* restricts the clockwise rotation of the guide 37.

Although the guide 37 according to the embodiment rotates by its weight to the position illustrated in FIG. 7, the guide 37 may rotate to the position illustrated in FIG. 7 by a biasing member, such as a spring. The rotating restrictor 39*a* is provided in the side toward which the guide 37 rotates by its weight, and is thus particularly effective as a unit to stop the rotation of the guide 37. The rotating restrictor 39*a* may solely be provided as a unit to restrict the rotational direction. By restricting the rotational direction of the motion, the guide 37 cannot rotate further than where the rotating restrictor 39*a* is provided even when pressed by the recording sheet P.

As described above, by determining the position of the guide 37, the stably positioned guide 37 can guide the recording sheet P to a desired direction in a stable manner. How the guide 37 guides the recording sheet P will now be described.

As illustrated in FIG. 7, a case when the recording sheet P is conveyed in the direction indicated by the arrow C2 toward the conveyance roller shaft 34*b* will now be described. Even in such a case, the guide 37 provided between the reverse conveyance path 6*a* and the conveyance roller shaft 34*b* changes the conveyance direction of the recording sheet P to guide the recording sheet P to the reverse conveyance path 6*a*. Therefore, the leading edge of the recording sheet P is prevented from abutting the conveyance roller shaft 34*b*, so jamming is prevented at this section. Furthermore, the recording sheet P does not make contact with the conveyance roller shaft 34*b* so that the recording sheet P catching water drops can be prevented.

The bent portion 37*a*, which is the upstream end of the guide 37 in the conveyance direction of the recording sheet P, slants toward the front cover 36, that is, to the opposite side of the reverse conveyance path 6*a*. This means that the upstream end is recessed from the conveyance rib 38. With this configuration, even when the recording sheet P is conveyed with its leading edge lifted, for example by curling, toward the front cover 36, the leading edge of the recording sheet P will not get into the back side of the bent portion 37*a*.

To the downstream in the conveyance direction C1 of the recording sheet P, the guide 37 slants toward the side opposite to the reverse conveyance path 6*a* (to the right side in the drawing). Thus, the surface of the slanting portion of the guide 37 does not project from the conveyance path of the recording sheet P. Therefore, the recording sheet P does not jam at the slanting portion of the guide 37 when conveyed along the reverse conveyance path 6*a*. If the slanting portion were to catch a water drop, the water drop runs down on the surface of the slanting portion to the right bottom in the figure. Since a water drop runs in the direction to separate from the reverse conveyance path 6*a*, the possibility of water on the guide 37 dropping by its weight toward the reverse conveyance path 6*a* can be reduced.

Alternatively, the guide 37 can be made of a conductive material. When made of a conductive material, the guide 37 can neutralize the recording sheet P by making contact. When the guide 37 is made of metal, condensation may occur on the surface of the metal guide 37 and the recording sheet P might catch water drops. Therefore, the guide 37 is preferably made of a conductive resin.

Figure 8:
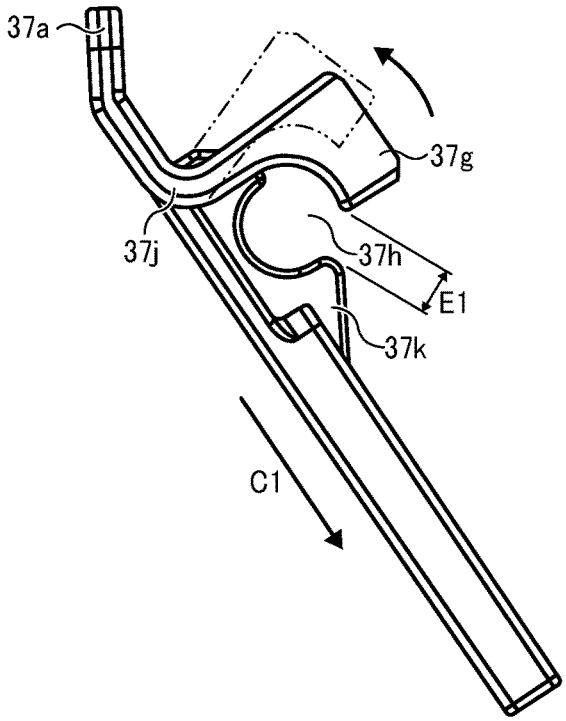
FIG. 8 is a side view of the guide according to the first embodiment.

FIG. 8 is a plan view illustrating the guide 37 viewed from the side. The deformable portion 37*g* has on its root a curved portion 37*j*. The curved portion 37*j* can deform easily by having a large curved shape and a smaller thickness than the other part of the guide 37. The deformable portion 37*g* can elastically deform about the curved portion 37*j* as illustrated in dotted lines in the figure.

The guide 37 includes an opening 37*h* that has an open end having a width E1, the open end being formed between the deformable portion 37*g* and a projection 37*k*. By inserting the conveyance roller shaft 34*b* in the guide 37 from the opening 37*h*, the guide 37 hangs on the conveyance roller shaft 34*b*.

The width E1 of the opening 37*h* is set smaller than the diameter of the conveyance roller shaft 34*b*. When inserting the conveyance roller shaft 34*b* in the guide 37 from the opening 37*h*, the pressing force applied to the deformable portion 37*g* from the conveyance roller shaft 34*b* elastically deforms the deformable portion 37*g* as illustrated in the dotted lines in the figure to increase the width of the opening 37*h* temporarily. When the conveyance roller shaft 34*b* is inserted and the pressing force is no longer applied to the deformable portion 37*g*, the deformable portion 37*g* returns to the position illustrated in solid lines in the figure, decreasing the width of the opening 37*h* to hinder the conveyance roller shaft 34*b* from coming off easily (this configuration is known as so-called snap fitting). With this configuration, the guide 37 can be held on the conveyance roller shaft 34*b* without any additional member, and the guide 37 and the conveyance roller shaft 34*b* can be assembled easily.

In the configuration allowing the guide 37 to be assembled to the conveyance roller shaft 34*b* by inserting the conveyance roller shaft 34*b* from the opening 37*h*, the distance between the guide 37 and the conveyance roller shaft 34*b* can be minimized. In this configuration, the sectional area occupied by the disposed guide 37 can further be reduced, so the conveyance path of the recording sheet P is not narrowed more than required.

As illustrated in FIG. 6, a plurality of conveyance ribs 38 is arranged in X direction on the front cover 36. The conveyance ribs 38 have the same X direction thickness and the same shape. Thus, the guide 37 can selectively be positioned at any location where the conveyance rib 38 is positioned. Therefore, the interval between disposed guides 37 can desirably be adjusted. The number of the guides 37 to be disposed can be changed as desired. For example, a minimum number of guides 37 can be disposed to suitably guide the recording sheet P to avoid jamming of the sheet. Alternatively, the position of the guide 37 can be changed according to the width of the assumed recording sheet P to be conveyed. Since the leading edge, in particular, is likely to curl at both edges of the recording sheet P, disposing the guides 37 at locations corresponding to the inner vicinities of both edges of the recording sheet P is effective particularly for solving the aforementioned problem. As described above, the configuration that allows the adjustment of positions of the guides 37 can be realized by providing the guides 37 not throughout the entire range of the width of the recording sheet P but within a range corresponding to a partial width of the recording sheet P.

When the guide 37 is not disposed at every conveyance rib 38 as described above, the thickness of the conveyance rib 38 at which the guide 37 is not disposed may be increased, or a rib for preventing wrong assembly can be provided, to allow the guide 37 to be disposed only at a desired location. Such measures prevent disposing the guide 37 at a wrong location during assembling of the apparatus.

Figure 9:
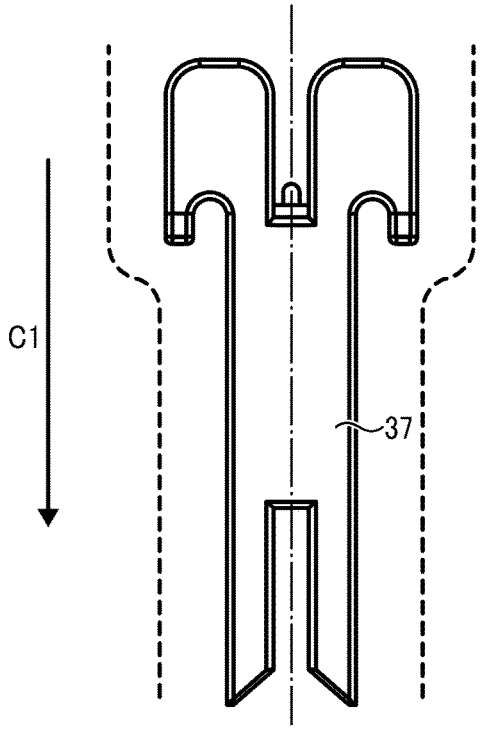
FIG. 9 is a front view of the guide according to the first embodiment.

As illustrated in FIG. 9, the guide 37 has a symmetrical shape with respect to a plane normal to the axis (X direction) of the conveyance roller 34. Thus, the shape of the guide 37 viewed from the center of the sheet passage span in the X direction is the same whether the guide 37 is disposed to the right or to the left from the center in the X direction. Therefore, the guides 37 of the same shape can be disposed on both sides in the X direction. Therefore, the number of items can be reduced, which reduces cost.

The guide 37 has a shape decreasing its width (the length in the right and left direction in the figure) from the upstream to the downstream in the conveyance direction C1 of the recording sheet P. This shape prevents the recording sheet P from being caught in the upper face of the guide 37 (the face provided on the upper portion in the figure) to cause jamming during conveyance.

The position where the recording medium conveying device 200 is provided will now be described. The recording medium conveying device 200 according to the first embodiment is disposed on the reverse conveyance path 6*a* and in the downstream of the fixing device 7. Since the leading edge of the recording sheet P is likely to curl, in particular, at a fixing stage where the sheet is heated, it is effective to provide the recording medium conveying device 200 in the downstream of the fixing device 7 as in the embodiment to prevent jamming of sheets and image defects.

However, a curl may happen before the recording sheet P is conveyed to the fixing device 7. Other than curls of a sheet, different factors may cause the recording sheet P to be conveyed to a wrong direction. Therefore, the position at which the recording medium conveying device 200 including the guide according to the embodiment of the present invention is provided is not limited to the position in the embodiment. Regarding that water heated and vaporized at the fixing device 7 disperses mainly upward of the fixing device 7, the guide 37 may be disposed on the roller pair disposed above the fixing device 7 in the horizontally placed image forming apparatus 1. This configuration is effective in preventing the recording sheet P catching a water drop.

The recording medium conveying device 200 according to the embodiment may be provided near and downstream of the fixing device 7 in the conveyance direction of the recording sheet P. In this configuration, components near the fixing device 7 receive heating effect from the fixing device 7 and are likely to expand by heat. The difference in the degree of deformation due to the difference in materials of the components is likely to create errors in dimensions and positional relationships. Even in such a case where dimensions of the neighboring components thermally expand to change their dimensions, the relative position of the guide 37 to the conveyance roller shaft 34*b* does not change because the guide 37 is directly fixed to the conveyance roller shaft 34*b* as described above. Therefore, the change in the guiding direction of the guide 37 is small, which minimizes the effect of thermal expansion.

As described above, since the guide 37 is provided at a portion, not throughout the entire width, of the recording sheet P, the parts can be downsized. The change in dimension due to thermal expansion is proportional to the size of the part, so the downsizing of the guide 37 can reduce the effect of thermal expansion of the guide 37 itself.

When an image is fixed by the fixing roller 26 and the pressure roller 27 in the fixing device 7, moisture transfers from the high temperature fixing roller 26 to the pressure roller 27 in the recording sheet P, frequently causing the recording sheet P to curl toward the pressure roller 27. Therefore, by providing the guide 37 to the side which the face of the recording sheet P pressed by the pressure roller 27 faces, jamming of sheets and image defects can effectively be prevented.

In the recording medium conveying device 200 according to the first embodiment, the guide 37 is provided in the same side as the front cover 36, which is an exterior portion of the image forming apparatus 1. This is the right hand side of the reverse conveyance path 6*a* in FIG. 1, namely, the side which the face of the recording sheet P pressed by the pressure roller 27 faces. Therefore, jamming and image defects are effectively prevented.

However, since different factors cause the recording sheet P being conveyed to a wrong direction as described above, the guide 37 is not necessarily be disposed in the side which the face of the recording sheet P pressed by the pressure roller 27 faces. For example, on the outer circumferential side of the curved face of the passage along which the recording sheet P is conveyed, the recording sheet P tends to curl to form a larger curvature, and thus the guide 37 may be provided in the inner circumferential side of the curved face of the passage.

Figure 10:
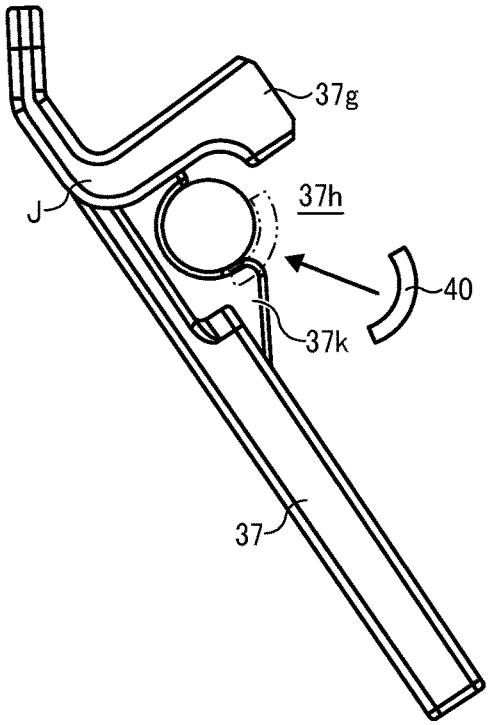
FIG. 10 is a plan view of a guide according to a second embodiment of the present invention.

A guide 37 according to a second embodiment of the present invention is illustrated in FIG. 10. The guide 37 according to the second embodiment is formed such that the portion corresponding to the curved portion 37*j* of the first embodiment (the portion indicated by J in the figure) is made thick to disallow elastic deformation and to have high strength. The width of an opening 37*h* is set larger than the diameter of the conveyance roller shaft 34*b*.

The guide 37 according to the second embodiment is disposed on the conveyance roller shaft 34*b* by inserting the conveyance roller shaft 34*b* from the opening 37*h* and then letting a projection 37*k* hold a stopper 40 that serves as a holder to cover the opening 37*h* (as illustrated in dotted lines in the figure). With this configuration, the conveyance roller shaft 34*b* is prevented from dropping off through the opening 37*h*, which is wider than the diameter of the conveyance roller shaft 34*b*, and thus the guide 37 is kept hanging on the conveyance roller shaft 34*b* to be positioned in Y and Z directions.

Any method can be used to hold the stopper 40 on the projection 37*k* as long as the method provides sufficient strength against the weight load of the conveyance roller shaft 34*b* to hold the stopper 40. For example, a claw may be provided on one side and a hole may be provided on the other side to engage the claw with the hole. The stopper 40 is not necessarily held on the projection 37*k*. Instead of providing the holder as a separate part like the stopper 40, a lock device that closes the opening 37*h* may be provided near the opening 37*h*, so that the conveyance roller shaft 34*b* inserted from the opening 37*h* can be locked.

Different from the first embodiment, the second embodiment has the thick J-portion that has high strength and does not elastically deform. Deformation of the J-portion under a long-term operation of the guide 37 and the apparatus and heat generated in the apparatus is small, so the noise caused by the change in dimensions can be prevented. Furthermore, the opening 37*h* is surely covered by the stopper 40 at a lower portion, so the conveyance roller shaft 34*b* will not drop off through the opening 37*h*.

Figure 11A:
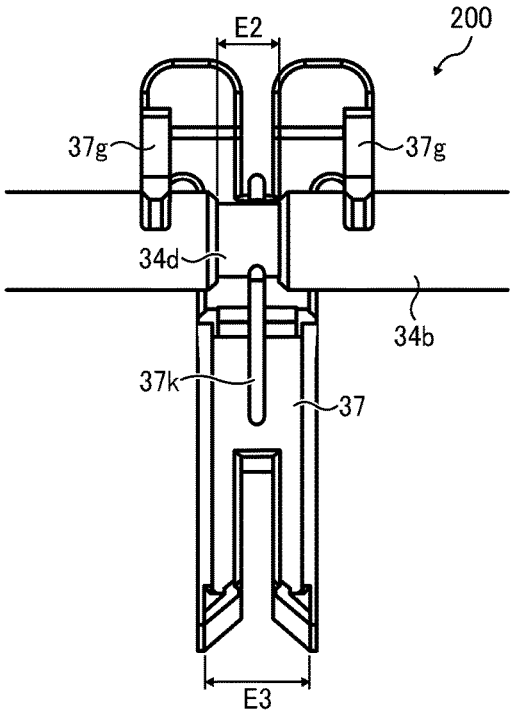
FIG. 11A is a plan view of a recording medium conveying device according to a third embodiment of the present invention.
Figure 11B:
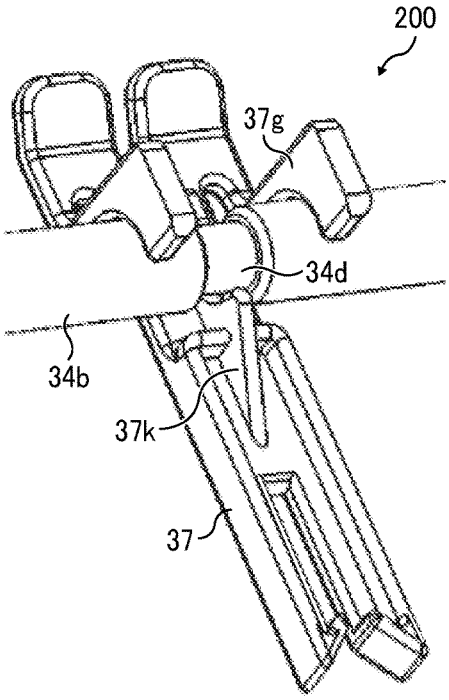
FIG. 11B is a perspective view of the recording medium conveying device according to the third embodiment.
Figure 12:
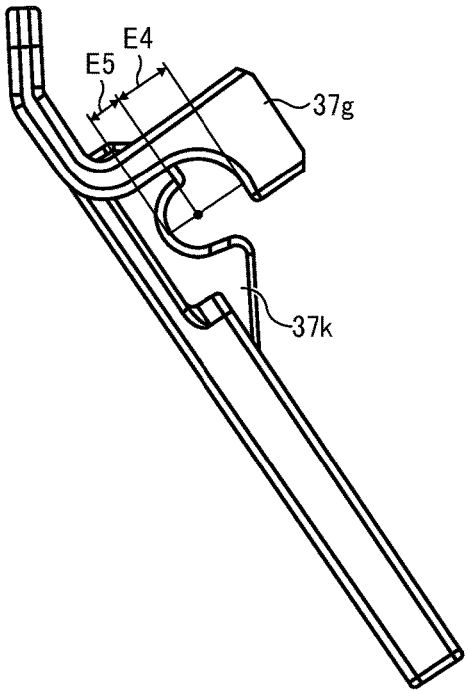
FIG. 12 is a plan view of the guide according to the third embodiment.

As illustrated in FIGS. 11A and 11B, a recording medium conveying device 200 according to a third embodiment is provided with a recessed portion 34*d* for temporality attaching the guide 37 to the conveyance roller shaft 34*b*. The recessed portion 34*d* has a smaller diameter than the other portion of the conveyance roller shaft 34*b* and forms a radially recessed section.

To assemble a plurality of guides 37 to the conveyance roller shaft 34*b*, the guide 37 may be attached one at a time to the conveyance roller shaft 34*b* assembled to an image forming apparatus 1, or alternatively, the conveyance roller shaft 34*b* with a plurality of guides 37 assembled thereto may be assembled to the image forming apparatus 1. In the latter case, however, the guide 37 attached to the conveyance roller shaft 34*b* is not supported in the axial direction of the conveyance roller shaft 34*b* and thus can freely move along the conveyance roller shaft 34*b* during the assembling of the conveyance roller shaft 34*b* to the image forming apparatus 1. The latter case has poor workability because the process of interposing the conveyance rib 38 in the upstream groove 37*c* and the downstream groove 37*f* of the guide 37 on the conveyance roller shaft 34*b* during the assembling of the conveyance roller shaft 34*b* to the image forming apparatus 1 is difficult.

In the third embodiment, the recessed portion 34*d* is provided on the conveyance roller shaft 34*b*. By temporarily attaching the projection 37*k* to the recessed portion 34*d*, the movement of the guide 37 along the conveyance roller shaft 34*b* can be limited within the width of the recessed portion 34*d* during the assembling of the conveyance roller shaft 34*b* to the image forming apparatus 1. By limiting the movement of the guide 37 along the conveyance roller shaft 34*b*, the conveyance rib 38 can easily be interposed in the upstream groove 37*c* and the downstream groove 37*f*. With the projection 37*k* temporarily attached to the recessed portion 34*d*, the two deformable portions 37*g* are assembled onto the conveyance roller shaft 34*b*, and thus the guide 37 is assembled to the conveyance roller shaft 34*b* with three sections of the guide 37 making contact with the conveyance roller shaft 34*b*.

When the width E2 of the recessed portion 34*d* is too large, the guide 37 moves out of a targeted position, making it difficult to interpose the conveyance rib 38 in the upstream groove 37*c* and the downstream groove 37*f*. Therefore, the width E2 of the recessed portion 34*d* is set smaller than the width E3 of the downstream ends 37*e* in the embodiment.

The conveyance roller shaft 34*b* according to the third embodiment has the recessed portion 34*d* having a diameter different from other portions. The deformable portion 37*g* assembled to the recessed portion 34*d* includes a portion having a diameter of E4 to which the conveyance roller shaft 34*b* is assembled. The projection 37*k* includes a portion having a diameter of E5 to which the conveyance roller shaft 34*b* is assembled. The diameter E4 is larger than the diameter E5. The diameter E5 is sized such that the projection 37*k* cannot be attached to a portion other than the recessed portion 34*d*, so that wrong assembly can be prevented. In addition, since the conveyance roller shaft 34*b* and the recessed portion 34*d* can visually be checked, the assembling of the guide 37 is easy.

In the embodiment described above, the guide 37 guides the recording sheet P to the direction in which the recording sheet P does not make contact with the shaft member (the conveyance roller shaft 34*b*) of the conveyance roller 34 serving as a conveyor. The shaft member according to an embodiment of the present invention however can be used as a shaft member of a component other than a conveyor for conveying a recording medium.

Figure 13:
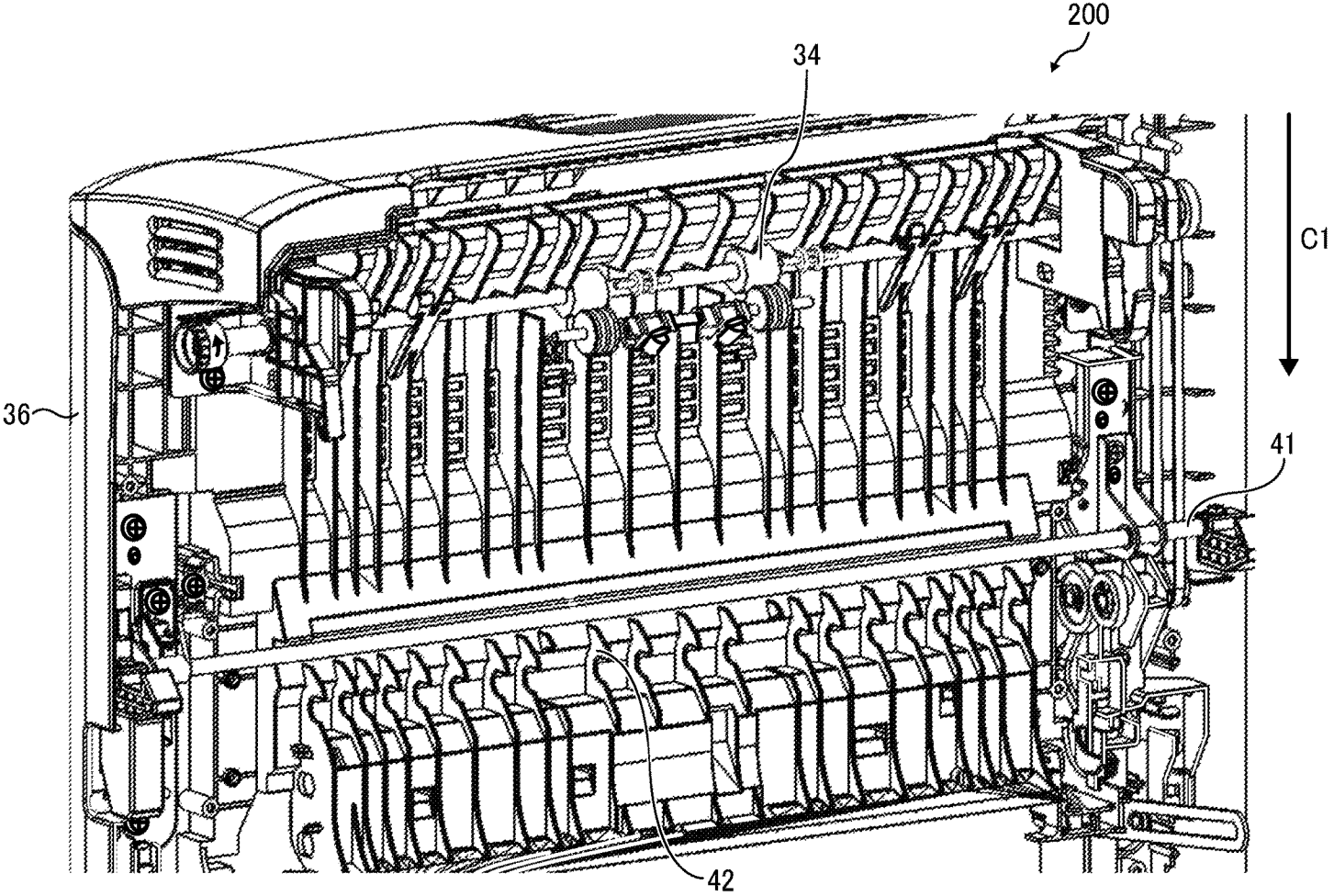
FIG. 13 is a perspective view of a shaft to which a guide according to a fourth embodiment of the present invention is provided.

As illustrated in FIG. 13, a recording medium conveying device 200 according to a fourth embodiment includes a guide 37 that guides a recording sheet P to a direction in which the recording sheet P does not make contact with a shaft 41 serving as a shaft member.

The shaft 41 is provided in the downstream of the reverse conveyance path 6*a* in the conveyance direction of the recording sheet P. The shaft 41 is a member provided separately from the conveyor to be used for opening a front cover 36. The shaft 41 is provided near the reverse conveyance path 6*a* and thus might make contact with the recording sheet P.

The guide 37 according to the fourth embodiment is provided to hang on the shaft 41. In this manner, the guide 37 is positioned in Y and Z directions. The guide 37 is positioned in X direction by a downstream conveyance rib 42 fixed on the front cover 36 to serve as a positioner. A rotation restrictor is provided on the front cover 36.

With this configuration, similarly to the first embodiment, the three-dimensional position of the guide 37 in X, Y, and Z directions is determined. Thus, the guide 37 can accurately guide the recording sheet P to the direction in which the recording sheet P does not make contact with the shaft 41.

The embodiments of the present invention are described above not by means of limitation on the present invention. It goes without saying that various modifications can be made without departing from the spirit and scope of the present invention. The image forming apparatus according to the embodiment of the present invention is not limited to the color image forming apparatus illustrated in FIG. 1, but may be a monochromatic image forming apparatus, a copier, a printer, a fax machine, or a multifunction peripheral thereof.

Although the guide 37 is made of a conductive resin material in the embodiment, the guide 37 is preferably made of an insulating material if conductivity of the guide 37 adversely affects secondary transfer to cause faulty image formation.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A recording medium conveying device, comprising:

a conveyor configured to convey a recording medium, the conveyer including a shaft;

a guide configured to guide the recording medium along a conveyance path to a predetermined direction; the guide being between the conveyance path and the shaft, the guide including an upstream end and a downstream end that are each bifurcated in a conveyance direction of the recording medium; and a positioner configured to position the guide in an axial direction of the shaft, the positioner including at least one rib projecting toward the conveyance path and extending in the conveyance direction such that the upstream end and the downstream end of the guide surround the at least one rib to restrict movement of the guide, wherein the guide is fixed by both the positioner and the shaft.

2. The recording medium conveying device according to claim 1, wherein the guide is disposed downstream from a fixing device in a direction of conveyance of the recording medium, the fixing device to fix an image on the recording medium.

3. The recording medium conveying device according to claim 1, wherein the guide includes a deformable portion being elastically deformable and an opening having an open end, and wherein the deformable portion is located at the open end, the guide being is positioned by the shaft with the shaft inserted in the guide from the opening, and elastic deformation of the deformable portion extending the opening allows the shaft to be inserted in the guide from the opening.

4. The recording medium conveying device according to claim 1, further comprising;

a holder to prevent the shaft dropping off from the guide with the shaft inserted in the guide from an opening of the guide.

5. The recording medium conveying device according to claim 1, wherein the guide has a symmetrical shape with respect to a plane normal to the axial direction of the shaft.

6. The recording medium conveying device according to claim 1, wherein, with the guide mounted in a horizontally placed image forming apparatus, the guide is disposed above a fixing device to fix an image on the recording medium.

7. The recording medium conveying device according to claim 1, wherein the upstream end of the guide in a direction of conveyance of the recording medium slants toward a side opposite to the conveyance path.

8. The recording medium conveying device according to claim 1, wherein the guide has a slant to distance from the conveyance path toward a downstream side in the conveyance direction of the recording medium.

9. An image forming apparatus, comprising;

the recording medium conveying device according to claim 1.

10. The recording medium conveying device according to claim 1, wherein the guide is configured to block condensation from the shaft from reaching the recording medium.

11. The recording medium conveying device according to claim 1, wherein the positioner configured to resist the guide from moving in an axial direction of the shaft such that the guide remains in a same position irrespective of axial movement of the shaft.

12. The recording medium conveying device according to claim 1, further comprising:

a biasing device configured to rotate the guide about the shaft.

13. The recording medium conveying device according to claim 1, wherein the guide includes a conductive material configured to neutralize the recording medium.

14. The recording medium conveying device according to claim 1 wherein the guide is configured to block the recording medium from contacting the shaft.

15. A guide configured to guide a recording medium along a conveyance path, the guide being between the conveyance path and a shaft of a conveyer, the guide comprising:

a guide face; and an upstream end and a downstream end between the guide face, the upstream end and the downstream end each being bifurcated in a conveyance direction, the upstream end and the downstream end of the guide configured to surround at least one rib of a positioner to restrict movement of the guide.

16. The guide according to claim 15, wherein the guide is configured to block condensation from the shaft from reaching the recording medium.

17. The guide according to claim 15, wherein the guide includes a conductive material configured to neutralize the recording medium.

18. The guide according to claim 15, wherein the guide is configured to block the recording medium from contacting the shaft.

* * * * *